US006644655B2

(12) United States Patent
Würschum

(10) Patent No.: US 6,644,655 B2
(45) Date of Patent: Nov. 11, 2003

(54) EQUIPMENT FOR DISTRIBUTING FLEXIBLE SHEET-SHAPED OBJECTS

(75) Inventor: Hans-Peter Würschum, Ostifldern (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/956,410

(22) Filed: Sep. 19, 2001

(65) Prior Publication Data

US 2002/0109290 A1 Aug. 15, 2002

(30) Foreign Application Priority Data

Sep. 20, 2000 (DE) ..... 100 46 468

(51) Int. Cl.[7] ..... B65H 5/00

(52) U.S. Cl. ..... 271/225; 271/298; 271/302; 271/303

(58) Field of Search ..... 271/298, 302, 271/303, 225

(56) References Cited

U.S. PATENT DOCUMENTS

| | | | | |
|---|---|---|---|---|
| 4,277,061 A | | 7/1981 | Nagel et al. | |
| 4,486,015 A | | 12/1984 | Takahashi | |
| 4,785,942 A | * | 11/1988 | Van Leijenhorst et al. | 209/657 |
| 4,958,828 A | | 9/1990 | Saito | |
| 4,986,529 A | * | 1/1991 | Agarwal et al. | 271/291 |
| 5,083,769 A | * | 1/1992 | Young, Jr. | 271/280 |
| 6,234,475 B1 | * | 5/2001 | Weigel et al. | 271/303 |

FOREIGN PATENT DOCUMENTS

| | | |
|---|---|---|
| DE | 14 99 553 A | 3/1970 |
| DE | 39 14 183 C2 | 11/1989 |
| DE | 196 48 181 A1 | 5/1998 |
| DE | 198 02 995 C2 | 8/1999 |
| DE | 200 06 890 U1 | 7/2000 |

* cited by examiner

*Primary Examiner*—Donald P. Walsh
*Assistant Examiner*—Kaitlin Joerger
(74) *Attorney, Agent, or Firm*—Kevin L. Leffel

(57) ABSTRACT

The invention relates to a device for distributing flexible sheet-shaped objects into multiple selectable target stations of a sheet material processing device, wherein the distributing device is mounted between a supply station and sheet conveyor units of the target stations. According to a preferred embodiment, the distributing device has several sheet deflecting elements that are connected together, and which are moveable together by a single drive unit.

18 Claims, 5 Drawing Sheets

EQUIPMENT FOR DISTRIBUTING FLEXIBLE SHEET-SHAPED OBJECTS

DESCRIPTION

The invention relates to a device for distributing flexible sheet-shaped objects to selectable target stations of a sheet material processing device, wherein the distributing device is mounted between sheet conveyor units of the target stations and a supply station of the equipment.

Devices for distributing flexible sheet-shaped objects to selectable target stations of the type named above are used in a known sheet material processing device.

DE 196 48 181 A1 discloses a sheet distributing unit of the type mentioned above for transporting flexible flat objects by a belt conveyor system, especially sheets of paper. In this process, three sheet deflecting elements form a three-way shunt. The three-way shunt comprises, in detail, a height-adjustable pad roller, a stationary guiding wedge and a second guide wedge that can be adjusted and/or swiveled, which are mounted between two successive lower belt conveyor sections.

The disadvantage with DE 196 48 181 device is the complicated structure and complicated operation of the individual deflecting elements of the sheet-distributing unit.

SUMMARY OF THE INVENTION

According to an aspect of the invention, a distributing device is provided comprising several sheet deflecting elements that are connected to each other, and can be brought into shunt positions assigned to target stations.

DETAILED DESCRIPTION

Various aspects of the invention are presented in FIGS. 1–5, which are not drawn to scale, and wherein like components in the numerous views are numbered alike. As presented herein, the device is used in a conventional sheet material processing machine that is only partially shown, for example a copy machine. For a person skilled in the art, it is apparent that the invented device can also be used in other equipment, without limitation, e.g. in printers or collating devices. Also, various types of sheets having various dimensions may be used in the practice of the invention.

Figure 1:
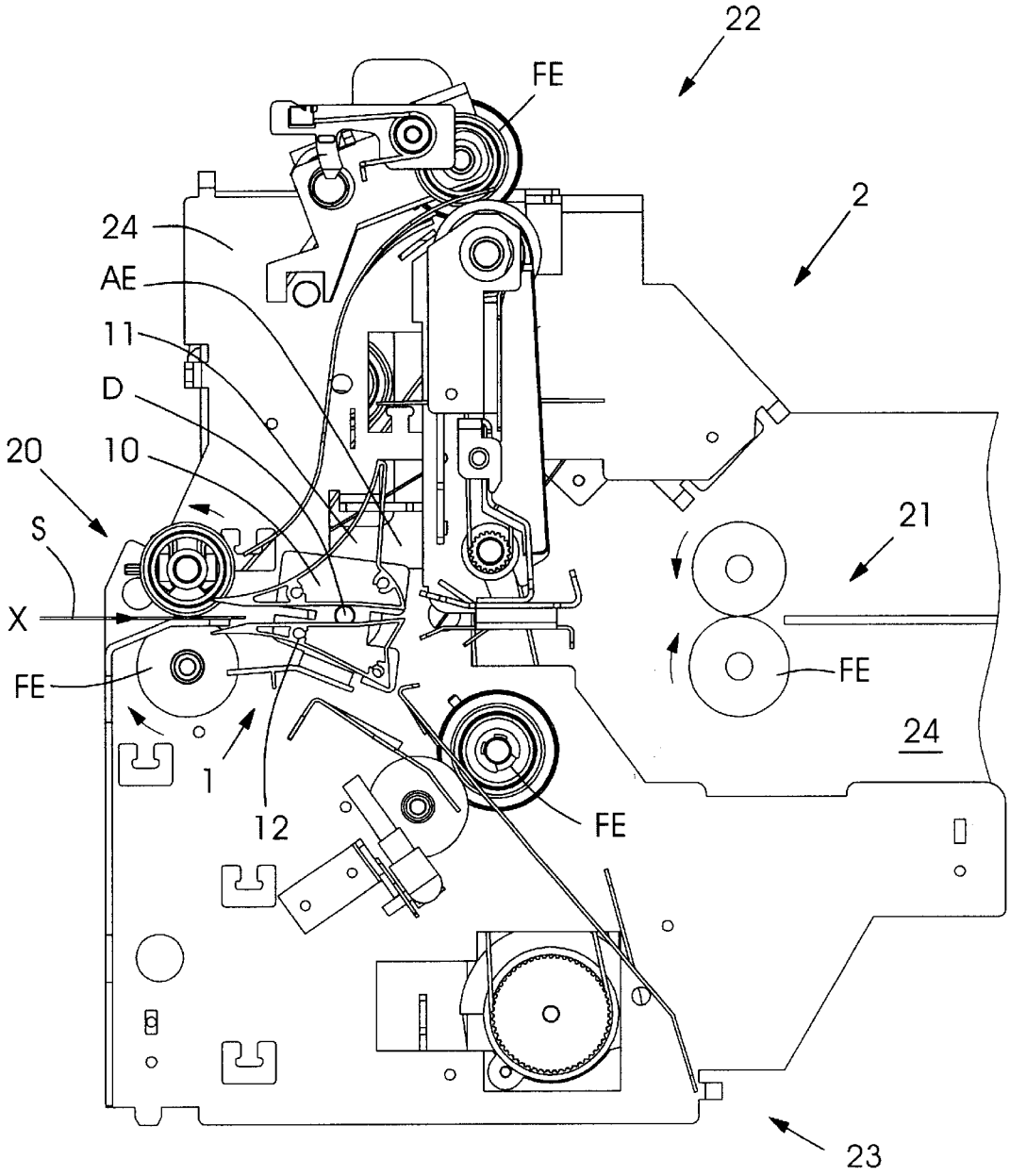
FIG. 1 presents a side view of a device according to an aspect of the invention in a partially displayed sheet material processing device.

Referring now specifically to FIG. 1, a device 1 for distributing paper sheets S, according to an aspect of the invention, is mountable between sheet conveyor units FE of three sheet target stations 21;22;23 and a sheet supply station 20 of copy machine 2. Conventional sheet-conveyor units FE are mounted on a frame 24 and directed to the individual stations 20;21;22;23 of device 2, which are only partially shown, may have a microprocessor-controlled conveyor roll that is driven depending on the shunt setting of the distributing device and a freely-turning contact roller. In the preferred embodiment that is shown, sheet supply station 20 is mounted to the left of distributing device 1 with its sheet conveyor X running horizontally and centered on distributing device 1 As shown, the target stations 21;22;23 are mounted to the right of the sheet distributing device, i.e. downstream with respect to sheet conveyor device X, whereby one of the target stations 21 lies in an extension of the horizontal sheet conveyor X for sheet supply station 20, and the two others are mounted above and below this center sheet target station 21. The device 1 directs sheets to the target stations 21;22;23 via corresponding conveyor units FE. In this process, the sheet-distributing device 1 is a part of this sheet-guiding channel.

As presented in FIGS. 1–5, the distributing device 1 has sheet deflecting elements 11;12 that are connected to each other, and which are moveable together about a single axis of rotation D by means of a drive unit AE, preferably a single drive unit, and brought into the shunt positions assigned to target stations 21;22;23. According to a preferred embodiment, the sheet deflecting elements 11;12 are jointly rotatable about the single axis of rotation. The sheet deflecting elements may be rigidly connected together.

Figure 2:
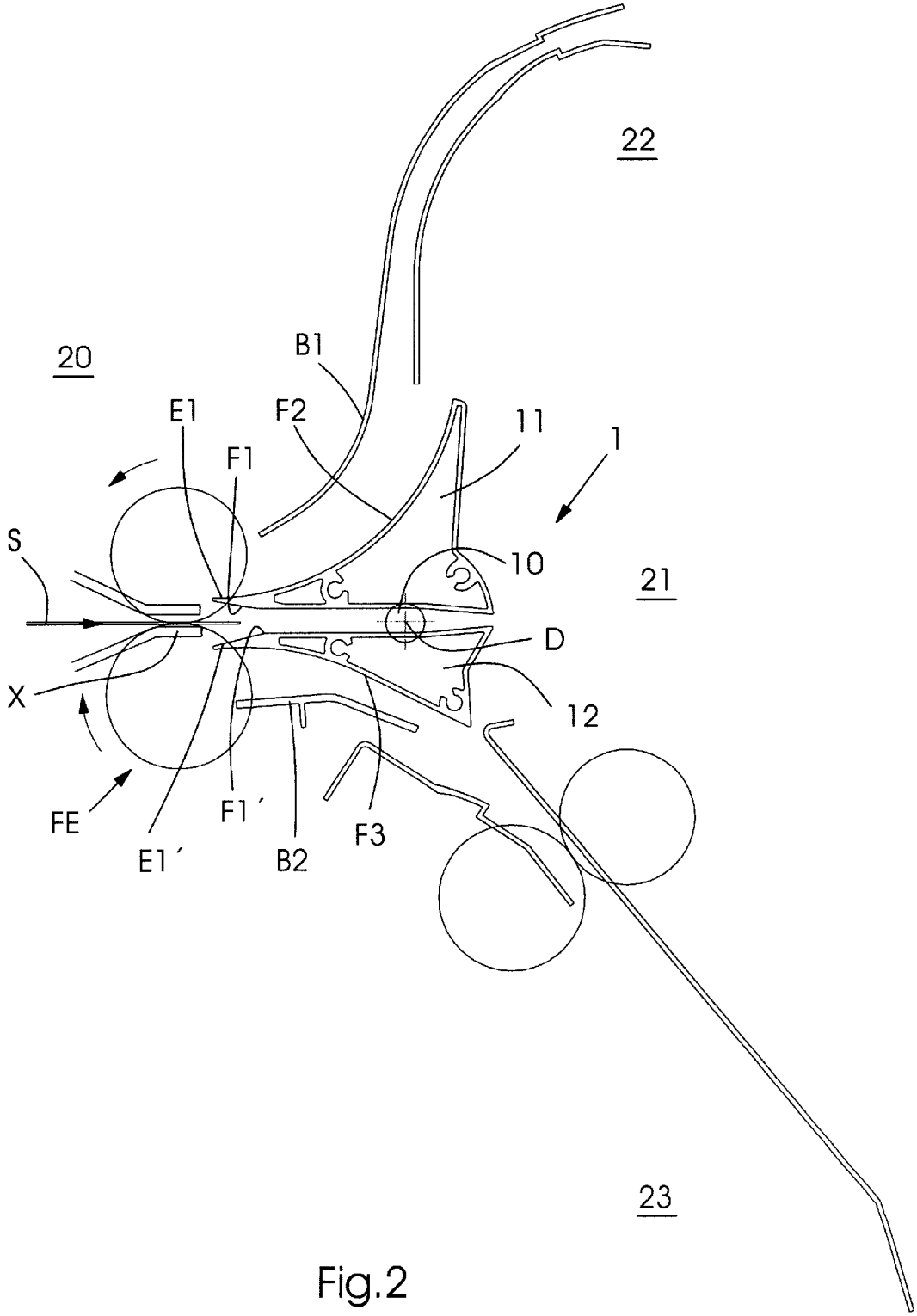
FIG. 2 presents the device of FIG. 1 in an enlarged representation with a first, center shunt position of the sheet deflecting elements between the sheet supply station and a first, center sheet target station.

In device 1, two sheet deflecting elements 11;12 are provided that are mounted on both sides, at a distance radially to the axis of rotation D, on a common swivel bracket 10 for example, and each having a first sheet-guiding surface F1;F1' that is essentially plane parallel to the other in this bracket in such a way that between the first sheet guide surface F1;F1', as shown in FIGS. 1 and 2, a first, sheet guide path is formed between the first sheet guide surfaces F1;F1'. The first sheet guide surfaces F1;F1' face each other. The sheet guide path corresponds to a first, horizontal shunt position of the deflecting elements 11;12 and is positioned in between the sheet supply station 20 and the first, center sheet target station 21.

The two sheet deflecting elements 11;12 each have an essentially wedge-shaped profile when viewed in cross-section perpendicular to the axis of rotation D, whose wedge tip ends E1;E1' are aligned in the direction upstream to the sheet supply station 20 and extend into the area of the sheet conveyor FE directed sheet supply station 20. The wedge tip ends are configured to intersect the path of sheets from the sheet supply station.

A surface that forms a wedge tip E1;E1' with the first sheet guide surface F1;F1' of deflecting elements 11;12 forms on the one side an upper, second sheet guide surface F2 at the first, upper sheet deflecting element, and on the other side it forms a lower or third sheet-guiding surface F3 on the second, lower sheet deflecting element 12 in such a way that when sheet deflecting elements 11;12 are swiveled into the second, lower or third, upper shunt position, a second or third sheet supply path and/or sheet guiding channel can be produced that goes to the second, upper 22 or third, lower 23 sheet target station. The second and third sheet guide surfaces F2 and F3 are preferably divergent in a direction of sheet travel, as shown, with the first sheet guide surfaces F1;F1' between the two.

Figure 3:
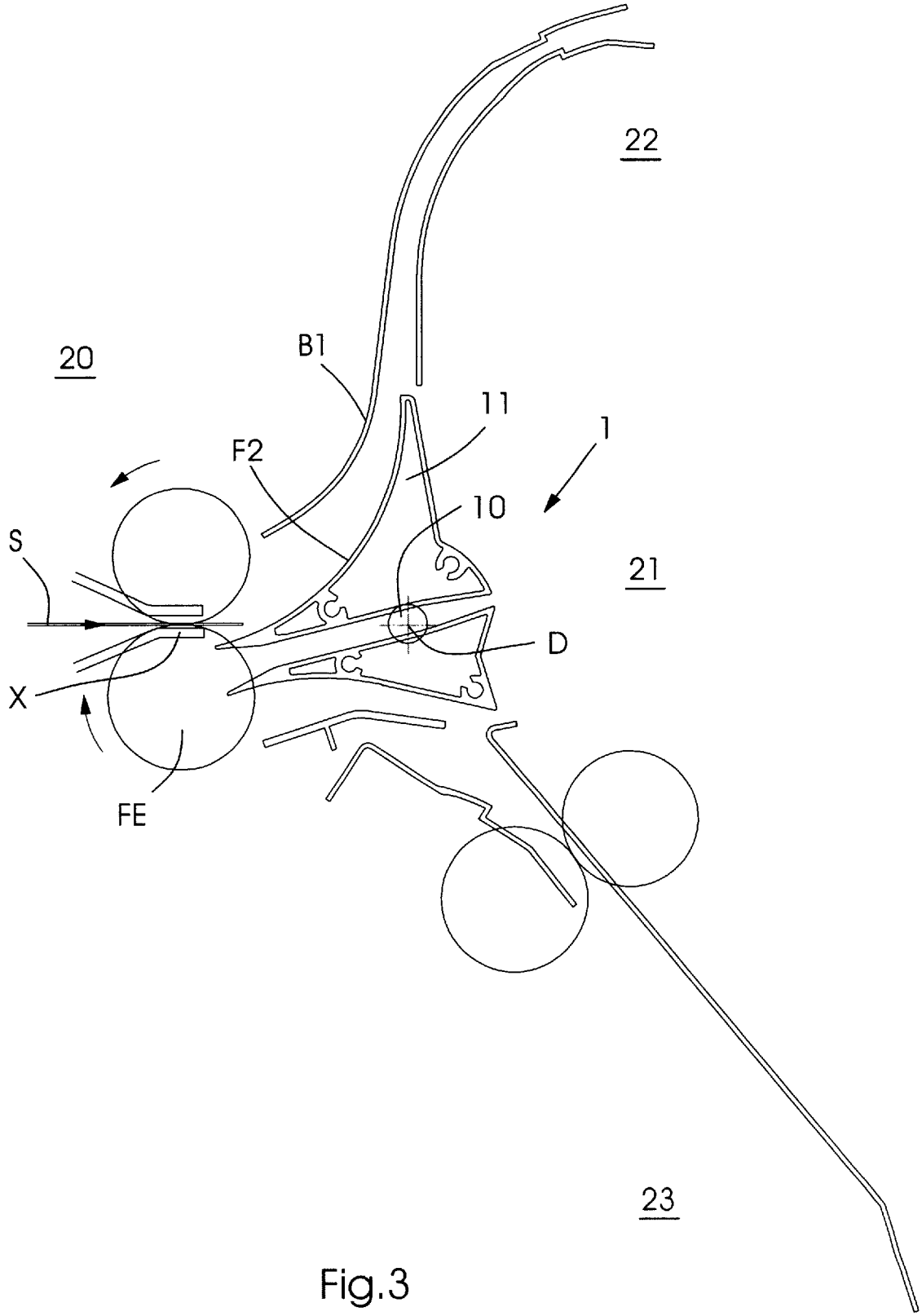
FIG. 3 presents the of device of FIG. 2 in a second, lower shunt position of the sheet deflecting elements between the sheet supply station and a second, upper sheet target station.
Figure 4:
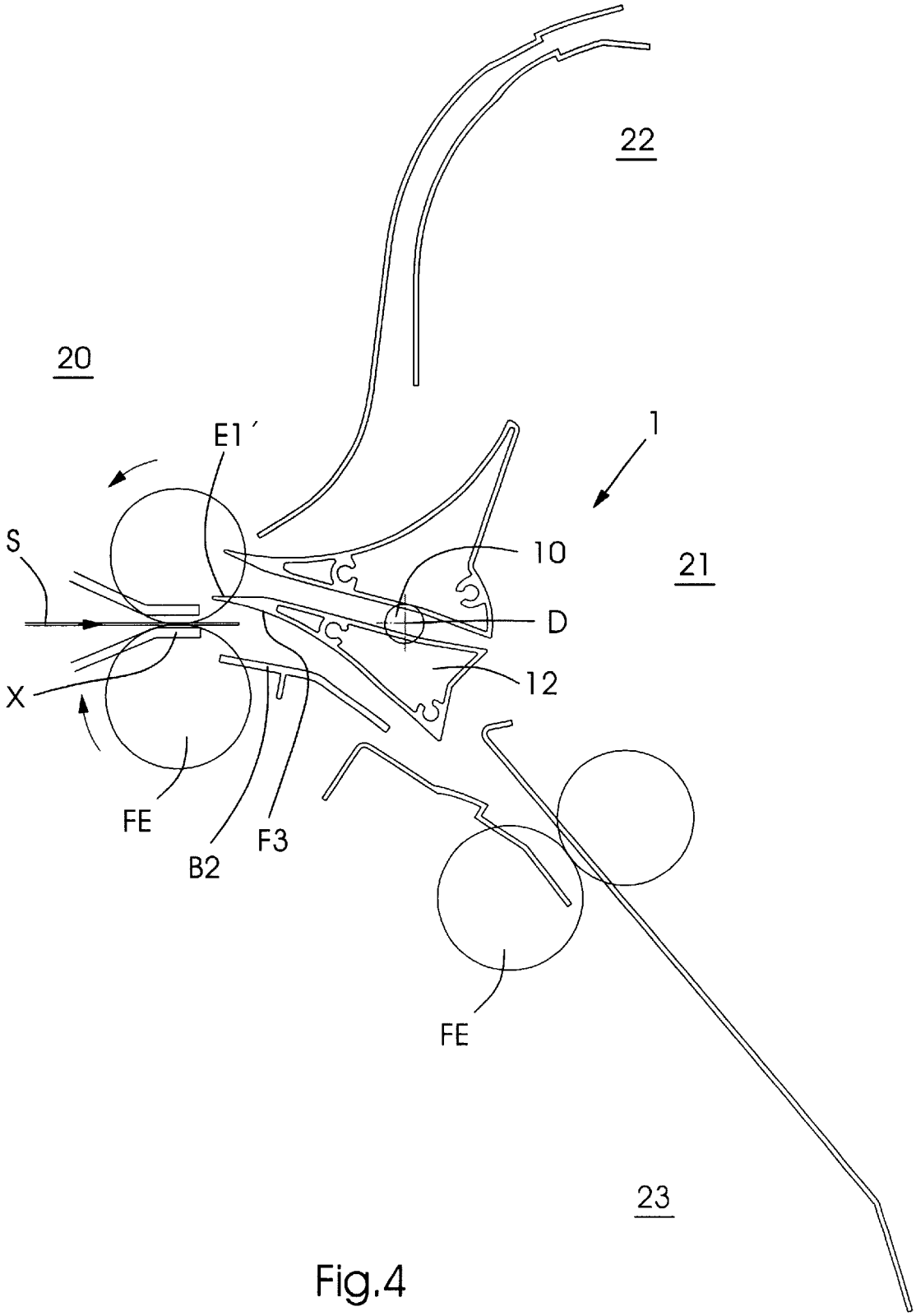
FIG. 4 presents the device of FIG. 2 in a third, upper shunt position of the sheet deflecting elements between the sheet supply station and a third, lower sheet target station.

As shown in FIG. 3, in the second shunt position of sheet deflecting elements 11;12 the wedge tip E1 of the upper, second sheet guide surface F2 is swiveled below the sheet conveyor X of the sheet supply station 20, so that a sheet S, which is supplied from the supply station, passes over the upper guide surface F2 of the first, upper deflecting element upward into the second target station 22, and as shown in FIG 4, in the third shunt position of the sheet deflecting elements 11;12, the wedge tip E1' of the lower, third sheet guiding surface is swiveled above the sheet conveyor X of sheet supply station 20 so that a sheet S, which supplied from the supply station 20, passes over the lower guide surface F3 of the second, lower deflecting element 12 downward into the third target station 23.

Above the upper, second sheet guide surface F2, on one side a first, upper sheet guide B1 comprising a supplemental sheet guide surface is mounted to form the upper sheet guide channel and on the other side, below the lower, third sheet guiding surface F3, a second, lower sheet guide B2 having another supplemental sheet guide surface is mounted to form the lower sheet guide channel. According to a further aspect of the invention, the first, upper sheet guide B1 is stationary and the second sheet guide B2 is mounted so that it can swivel depending on the position of distributing device 1.

In an alternative embodiment that is not shown, the lower, second sheet guide B2 of the lower sheet guide channel may also be mounted so that it is stationary.

The first sheet guide surfaces F1;F1' of distributing device 1 and the first and second sheet guides B1; B2 of the upper and lower sheet guide channels preferably have a convex curve to better deflect the sheets and the second F2 and third F3 sheet guide surfaces of distributing device 1 preferably have a concave curve for the same reason.

Figure 5:
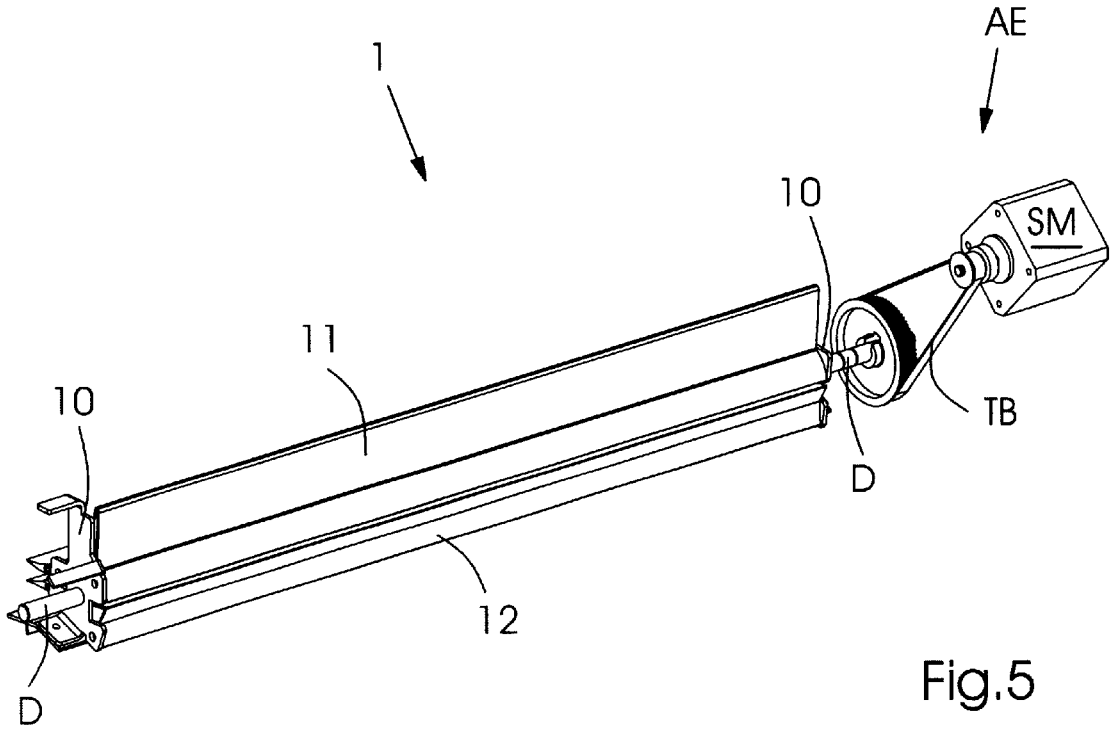
FIG. 5 presents a partial three-dimensional representation of a device according to a further aspect of the invention with a drive unit.

As shown in FIG 5, the drive unit AE used to swivel the sheet deflecting elements 11;12 of the sheet distributing 1 has a microprocessor-controlled stepper motor SM with a conventional toothed belt drive TB. On one axial end of rotation axle D, which on its axial ends has brackets 10 in the form of centrally mounted flanges for the sheet deflecting elements 11;12 of sheet distributor 1, a toothed belt pulley is mounted on which a toothed belt of toothed belt drive TB acts. The swiveling of the sheet distributing device 1 into the three shunt positions 21;22;23 occurs according to the decision of an operator and is controlled by means of a control program in a conventional control unit, not shown, of device 2.

According to a further aspect of the invention, a method of distributing sheets to target stations 21;22;23 is provided, comprising guiding sheets through a guide path defined between a pair of sheet deflecting elements 11;12 to a first of the target stations 21;22;23, rotating the sheet deflecting elements 11;12 to a position about a single axis of rotation D wherein one of the sheet deflecting elements 11;12 defines a sheet guide surface F2 that guides sheets to a second of the target stations 21;22;23, and rotating the sheet deflecting elements 11;12 to another position about the single axis of rotation D wherein another of the sheet deflecting elements 11;12 defines another sheet guide surface F3 that guides sheets to a third of the target stations 21;22;23.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A device for distributing sheets to sheets target stations, said device being mountable between a supply station and sheet conveyer units directed to the target stations, said device having sheets deflecting elements jointly rotatable about a single axis of rotation and having sheet guide surfaces divergent in a direction of sheet travel, said sheet deflecting elements defining a sheet guide path between said sheet guide surface.

2. A device for distributing sheets to sheets target stations, said device being mountable between a supply station and sheet conveyer units directed to the target stations, said device having sheet deflecting elements jointly rotatable about a single axis of rotation and having sheet guide surfaces divergent in a direction of sheet travel;

wherein said sheet deflecting elements are mounted in a common swiveling bracket and define a sheet guide path between said sheet guide surfaces.

3. The device of claim 2, wherein:

one of said sheet deflecting elements comprises one of said sheet guide surfaces, said sheet deflecting elements being moveable to a position wherein said one of said sheet guide surfaces directs sheets to one of the sheet conveyor units; and, another of said sheet deflecting elements comprises another of said sheet guide surfaces, said sheet deflecting elements being moveable to another position wherein said another of said sheet guide surfaces directs sheets to another of the sheet conveyor units.

4. A device for distributing sheets to sheet target stations, said device being mountable between a supply station and sheet conveyor units directed to the target stations, said device having sheet deflecting elements jointly rotatable about a single axis of rotation and having sheet guide surfaces divergent in a direction of sheet travel;

wherein said sheet deflecting elements each define wedge tip ends facing the supply station and are configured to intersect a path of sheets from the sheet supply station.

5. The device of claim 4, wherein:

one of said sheet deflecting elements comprises one of said sheet guide surfaces, said sheet deflecting elements being moveable to a position wherein said one of said sheet guide surfaces directs sheets to one of the sheet conveyor units; and, another of said sheet deflecting elements comprises another of said sheet guide surfaces, said sheet deflecting elements being moveable to another position wherein said another of said sheet guide surfaces directs sheets to another of the sheet conveyor units.

6. The device of claim 4, wherein:

one of said sheet deflecting elements comprises one of said sheet guide surfaces terminating in one of said wedge tips, said sheet deflecting elements being moveable to a position wherein said one of said sheet guide surfaces intersects a path of sheets from the sheet supply station and directs sheets to one of the sheet conveyor units; and, another of said sheet deflecting elements comprises another of said sheet guide surfaces terminating in another of said wedge tip ends, said sheet deflecting elements being moveable to another position wherein said another of said sheet guide surfaces intersects the path of sheets from the sheet supply station and directs sheets to another of the sheet conveyor units.

7. A device for distributing sheets to sheet target stations, said device being mountable between a supply station and sheet conveyor units directed to the target stations, said device having sheet deflecting elements jointly rotatable about a single axis of rotation and having sheet guide surfaces divergent in a direction of sheet travel;

further comprising a supplemental sheet guide surface opposing one of said sheet guide surfaces and another supplemental sheet guide surface opposing another of said sheet guide surfaces.

8. The device of claim 7, wherein:

said sheet deflecting elements define a sheet guide path between said sheet guide surfaces;

said guide path comprises convex guide surfaces;

said sheet guide surfaces are concave; and, said supplemental sheet guide surfaces are convex.

9. A device for distributing sheets to sheet target stations, said device being mountable between a supply station and sheet conveyor units directed to the target stations, said device having sheet deflecting elements jointly rotatable about a single axis of rotation and having sheet guide surfaces divergent in a direction of sheet travel;

further comprising a microprocessor-controlled stepper motor with a toothed belt drive for moving said sheet deflecting elements.

10. A device for distributing sheets to first, second, and third target stations of a sheet material processing device, said device being mountable between a supply station and sheet conveyor units of the target stations, said device having sheet deflecting elements jointly rotatable about a single axis of rotation, said sheet deflecting elements defining first sheet guide surfaces facing each other for guiding sheets to the first target station, one of said sheet deflecting elements defining a second sheet guide surface for guiding sheets to the second target station, another of said sheet deflecting elements defining a third sheet guide surface for guiding sheets to the third target station.

11. The device of claim 10, wherein said first sheet guide surfaces are disposed in between said second and third sheet guide surfaces.

12. The device of claim 10, wherein said second and third sheet guide surfaces diverge in a direction of sheet travel.

13. The device of claim 10, further comprising a first supplemental sheet guide surface opposing said second sheet guide surface and a second supplemental sheet guide surface opposing said third sheet guide surface.

14. The device of claim 10, wherein said sheet deflecting elements are rigidly connected together.

15. A method of distributing sheets to target stations, comprising:

guiding sheets through a guide path defined between a pair of sheet deflecting elements to a first of said target stations;

rotating said sheet deflecting elements to a position about a single axis of rotation wherein one of said sheet deflecting elements defines a sheet guide surface that guides sheets to a second of said target stations; and, rotating said sheet deflecting elements to another position about said single axis of rotation wherein another of said sheet deflecting elements defines another sheet guide surface that guides sheets to a third of said target stations.

16. The method of claim 15, wherein said sheet guide surfaces are divergent.

17. The method of claim 15, further comprising rotating said sheet deflecting elements from one of said positions to another of said positions.

18. The method of claim 15, further comprising rotating said sheet deflecting elements to a first position from one of said second and third positions wherein said guide path guides sheets to said first of said target stations.

* * * * *